United States Patent [19]

Doi et al.

[11] 4,401,297

[45] Aug. 30, 1983

[54] SINTERING FURNACE FOR POWDER METALLURGY

[75] Inventors: Yoshihiko Doi; Toshikazu Hirayama; Yasushi Miyawaki; Masao Maruyama, all of Itami, Japan

[73] Assignee: Sumitomo Electric Industries, Ltd., Japan

[21] Appl. No.: 297,084

[22] Filed: Aug. 27, 1981

Related U.S. Application Data

[63] Continuation of Ser. No. 123,026, Feb. 20, 1980, abandoned, which is a continuation of Ser. No. 889,446, Mar. 23, 1978, abandoned.

[30] Foreign Application Priority Data

Mar. 30, 1977 [JP] Japan ..... 52-36825

[51] Int. Cl.[3] ..... F27B 5/12

[52] U.S. Cl. ..... 266/252; 266/259

[58] Field of Search ..... 266/249–254, 266/257, 259; 432/234, 233, 246; 148/126, 153, 156; 75/227; 13/31 R, 32, 33; 414/153, 154, 156, 198; 308/3 R, 3 C, 3.6, 6 R, DIG. 8, DIG. 15; 198/621, 721

[56] References Cited

U.S. PATENT DOCUMENTS

| | | | |
|---|---|---|---|
| 2,634,964 | 4/1953 | Cooper | 308/DIG. 8 |
| 3,171,756 | 3/1965 | Glenn | 266/254 |
| 3,234,640 | 2/1966 | Lewis | 13/31 R |
| 3,565,410 | 2/1971 | Scherff | 266/252 |
| 3,589,696 | 6/1971 | Western | 266/250 |
| 3,622,135 | 11/1971 | Roth et al. | 266/250 |
| 3,769,008 | 10/1973 | Borok et al. | 266/252 |
| 3,782,931 | 1/1974 | Brede et al. | 75/227 |
| 3,871,630 | 3/1975 | Wanetzky et al. | 266/252 |
| 4,009,872 | 3/1977 | McCoy | 266/252 |
| 4,071,382 | 1/1978 | Riopelle | 266/252 |
| 4,113,240 | 9/1978 | Klein | 266/252 |

FOREIGN PATENT DOCUMENTS

| | | | |
|---|---|---|---|
| 867249 | 5/1961 | United Kingdom | 266/252 |

*Primary Examiner*—Peter K. Skiff

*Attorney, Agent, or Firm*—Wenderoth, Lind & Ponack

[57] ABSTRACT

The present invention relates to a sintering furnace for powder metallurgy of cemented carbides, cermets and ceramics, which comprises a main furnace body, a heating chamber provided in the main body, a table having a moving means for carrying a workpiece in or out of the heating chamber and a means for cooling the interior of the furnace with a heat exchanger fitted to the exterior of the main furnace body, and a method for the sintering and heat treatment of cemented carbides in the sintering furnace as claimed in claim 1, which comprises sintering cemented carbides and cooling rapidly at a cooling rate of at least 30° C./min from the sintering temperature being at least a temperature at which a liquid phase appears to at most 1000° C. by the use of an inert gas as a coolant.

2 Claims, 2 Drawing Figures

SINTERING FURNACE FOR POWDER METALLURGY

This is a continuation of application Ser. No. 123,026, filed Feb. 20, 1980, abandoned, which is a continuation of application Ser. No. 889,446, filed Mar. 23, 1978, abandoned.

BACKGROUND OF THE INVENTION

1. Field of the Invention

The present invention relates to a method for the sintering treatment of cemented carbides and a sintering furnace used for the production of sintered hard alloys by powder metallurgy of cemented carbides consisting mainly of tungsten carbide, cermets consisting mainly of titanium carbide, ceramics consisting mainly of aluminum oxide, etc.

2. Description of the Prior Art

For the production of these alloys, there have hitherto been proposed a method comprising preparing a fine powder pulverized and mixed sufficiently in a desired proportion, subjecting to pressing and sintering the pressed body or compact as it is and a method comprising pre-sintering a pressed body or compact, subjecting to forming and then carrying out a final sintering. The above described fine powder is ordinarily mixed with a lubricant so as to decrease the friction among the powder particles or between the powder and a mold in a pressing operation, thereby raising the dimensional precision and preventing a sliding defect. Paraffin, wax, camphor and the like are used as such a lubricant. Since these lubricants are organic materials, however, it is necessary to install a pre-sintering furnace or to provide a sintering furnace with a means for removing the lubricant so that a product alloy is not affected by the carbon contained therein. Furthermore, it is necessary to provide such a furnace structure that such a lubricant oil is removed from a pressed body or compact at a temperature of as low as possible and the removed lubricant is not retained, deposited and accumulated in or on a heat treatment chamber, furnace wall, exhaust system, etc. The sintering furnace of the prior art, however, has not a suitable structure as a means for removing a lubricant and thus is not freed from the disadvantage that the lubricant is deposited and accumulated on the heat insulators, inner walls, pipes and valves of the exhaust system in the heat treatment chamber and the accumulated lubricant must be removed and swept, which requires much time and cost, resulting in lowering of the operating ratio of the furnace.

In general, unless the sintering temperature of a sintered hard alloy is sufficiently high, for example, 1200° C. or higher, a high density and high grade alloy cannot be obtained and in order to obtain a desired quality, it is important to select suitably an atmosphere during presintering, sintering and cooling. When a lubricant is removed followed by raising the temperature and sintering, the lubricant adhered to the furnace wall, etc. contaminates the atmosphere in the furnace and, accordingly, it is difficult to obtain a product with a high grade. When the processings such as presintering, sintering and cooling are continuously carried out in different atmospheres such as gaseous atmospheres and vacuum in the same furnace, a workpiece to be processed is usually moved to different processing positions at a high temperature and it is difficult to move a table carrying the workpiece precisely, for example, by revolving rollers or by moving a forklift since the roller or lift arm is often strained, fatigued or broken by thermal stress.

SUMMARY OF THE INVENTION

It is an object of the present invention to provide a sintering furnace used for the production of sintered hard alloys by powder metallurgy of cemented carbides, cermets and ceramics.

It is another object of the present invention to provide a sintering furnace whereby removal of a lubricant, pre-sintering, sintering and cooling can continuously be carried out in the same furnace to give a high processing efficiency.

It is a further object of the present invention to provide a sintering furnace for powder metallurgy whereby the above described disadvantages of the prior art can be overcome.

It is a still further object of the present invention to provide a method for the sintering treatment of cemented carbides.

These objects can be attained by a sintering furnace for powder metallurgy, which comprises a main furnace body, a heating chamber provided in the main furnace body, a table having a moving means for carrying a workpiece in or out of the heating chamber and a means for cooling the interior of the furnace with a heat exchanger fitted to the exterior of the main furnace body and by a method for the sintering and heat treatment of cemented carbides, which comprises sintering cemented carbides by a sintering furnace as described above and cooling rapidly at a cooling rate of 30° C./min or more from the sintering temperature at least at which a liquid phase appears to 1000° C. or less in an inert gas as a coolant.

BRIEF DESCRIPTION OF THE DRAWING

The accompanying drawings are to illustrate the principle and merits of the present invention in detail.

DETAILED DESCRIPTION OF THE INVENTION

Figure 1:
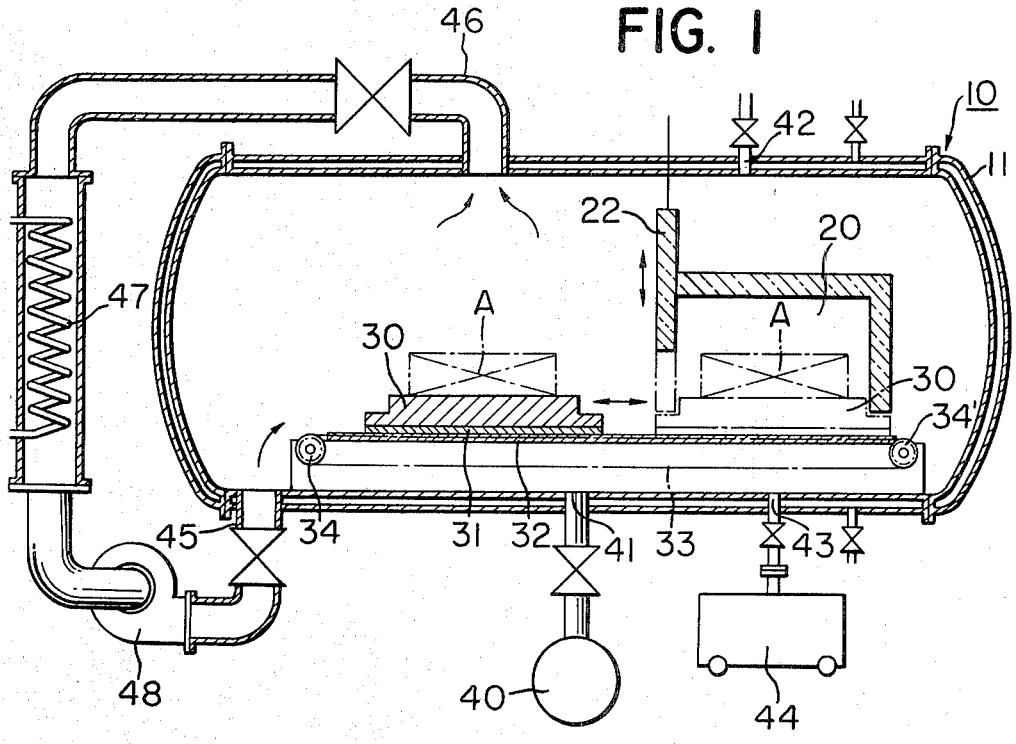
FIG. 1 shows an elevation view, partly in section, of a sintering furnace in accordance with the present invention
Figure 2:
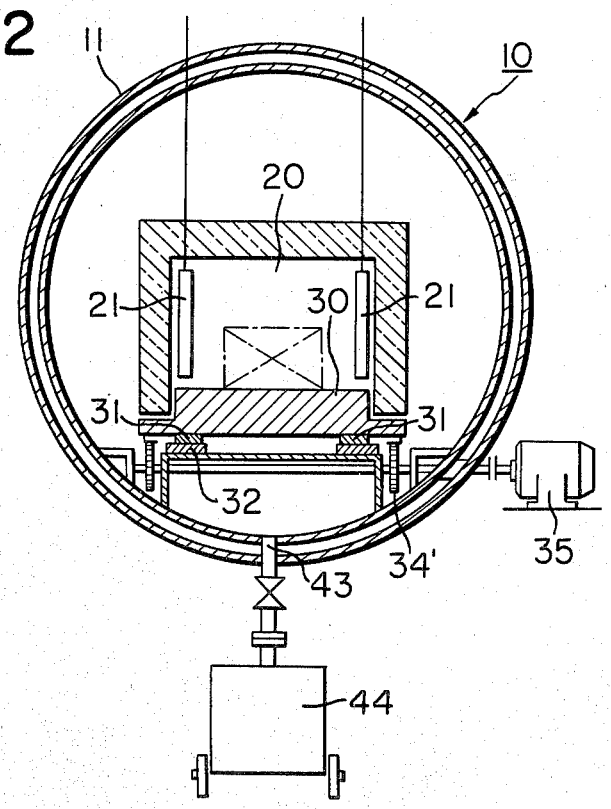
FIG. 2 shows a sectional view of the sintering furnace of FIG. 1.

In accordance with the present invention, there is provided a sintering furnace for powder metallurgy, which comprises a main furnace body, a heating chamber provided in the main furnace body, a table having a moving means for carrying a workpiece in or out of the heating chamber and a means for cooling the interior of the furnace with a heat exchanger fitted to the exterior of the main furnace body.

With reference to the drawing which shows a particular embodiment of the present invention, the numeral 10 refers to a main sintering furnace body in which there is provided a heating chamber 20 surrounded by heat insulator and provided with heating element of graphite 21 in the interior and door 22 as one side of heating chamber 20, capable of being opened and shut from the outside of the furnace body. The lower portion of heating chamber 20 is opened so that moving table 30 is inserted, to the lower surface of which graphite slide 31 is fixedly fitted. The graphite slide 31 is placed on graphite rails 32 so as to be moved along the rails.

Endless chain 33 is mounted on sprockets 34 and 34' along the travelling path of table 30 and a suitable position of chain 33 is fixed to table 30. Table 30 is moved by driving one of the above described sprockets by means of motor 35 arranged outside furnace body 10.

Main furnace body 10 is further provided with exhaust port 41 connected with vacuum pump 40, feed inlet 42 of inert gas and exhaust port 43 of a lubricant connected with tank 44. In addition, blast duct 45 and exhaust duct 46 are connected to main furnace body for the purpose of cooling and heat exchanger 47 and blower 48 are provided between these ducts. Main furnace body 10 is covered with jacket 11 through which cooling water or warming water can be circulated.

In the operation of the above described sintering furnace, a workpiece to be processed is charged in case A of graphite which is placed on table 30 outside heating chamber 20, door 22 of heating chamber is opened and then table 30 is moved from the position represented by solid line in FIG. 1 to that represented by chained line thus conveying case A in heating chamber 20.

Then door 22 is closed and the system is evacuated by means of vacuum pump 40 to keep the interior of main furnace body 10 in vacuum. The workpiece is gradually heated by heating element 21 to raise the temperature to about 200° C. or higher and a lubricant contained in the workpiece, for example, paraffin is thus removed in the form of liquid, which is dropwise discharged from table 30 and recovered from exhaust port 43 in tank 44.

After removal of the lubricant, the heating is continued to sinter the workpiece. For cooling the workpiece sintered in this way, door 22 of heating chamber 20 is firstly opened and table 30 is moved to the position represented by solid line in FIG. 1, while a gas is introduced into main furnace body 10 from gas feed inlet 42 and circulated by opening the valve of duct 45 and driving blower 48 thus effecting the cooling by heat exchanger 47. When the removal of the lubricant adhered to the furnace wall, etc. is difficult, in particular, a liquid at a temperature of higher than the melting point of the lubricant can be circulated through jacket 11. Furthermore, where it is desired to cool rapidly the workpiece from a suitable temperature after sintering, a cold liquid can be circulated through jacket 11.

The operation of the sintering furnace of the present invention, as described above, is limited to the case of removing a lubricant and then sintering, but, of course, can be applied to sintering of a workpiece from which a lubricant has already been removed.

The advantages or merits of the sintering furnace according to the present invention are summarized below:

(1) Removal of a lubricant, pre-sintering, sintering and cooling can continuously be carried out in the same furnace thus obtaining a high processing efficiency.

(2) Removal of a lubricant is carried out substantially completely with a high recovery ratio, so the atmosphere in the furnace is scarcely affected by the lubricant and a product with a high quality is thus obtained.

(3) The maintenance of the sintering furnace can be simplified because the recovery ratio of a lubricant is high and there is only a small chance of adhesion of the lubricant to the furnace wall and other mechanisms because of arrangement of a heat exchanger, etc. outside the furnace.

(4) Since the sliding part of graphite excellent in heat resistance as well as slidable property is used for the movement of the table carrying a workpiece, the precision of controlling the speed and positioning is increased and the durability of the moving mechanism is improved.

It is well known to introduce an inert gas or reducing gas into a furnace or to stir the gas in order to increase the cooling rate, but use of a gas circulating and cooling method with a heat exchanger has not been practised in a furnace wherein a pre-sintering and sintering are continuously carried out because a heat exchanger is contaminated with a lubricant evaporated during the pre-sintering. In the sintering furnace of the present invention, a heat exchanger is arranged outside the main furnace body and separated during pre-sintering and sintering from the main furnace body by valves, so that any gases generated until the sintering is finished do not reach the heat exchanger. The feature thereof consists in that the pre-sintering and sintering can be carried out in continuous manner without contamination with a lubricant in spite of that the sintering furnace is constructed of one body and, in addition, rapid cooling is possible during cooling by circulating a gas, which results in various merits in quality as well as in economy. That is to say, the pre-sintering and sintering are continuously carried out at the same position and, during the same time, a workpiece is processed continuously in vacuum without movement and exposure to the air, whereby the pre-sintered product is prevented from deterioration due to oxidation and moisture absorption and from breakage. Thereafter, the rapid cooling is effectively carried out and the quality of a product is thus improved.

When cemented carbides are subjected to rapid cooling, the strength thereof is increased as known in the art, but this has not been practised on a commercial scale. Now it is found that, when cemented carbides are subjected to rapid cooling using the sintering furnace of the present invention, the strength and wear resistance are considerably increased. The rapid cooling is herein carried out at a cooling rate of 30° C./min or more from the sintering temperature at which a liquid phase appears to 1000° C. or lower in an inert gas or in vacuum. The effect of this rapid cooling is apparent from the results in comparison of the products obtained by subjecting to sintering at 1400° C. followed by an ordinary cooling and by a rapid cooling with a circulated gas according to the present invention. The sintering temperature is generally a liquid phase-appearing temperature or more, for example, 1280° C. in the case of WC-Co system.

The method of the present invention is applicable to not only simple alloys of WC-Co type, but also to other cemented carbides in which a part or all of the WC is replaced by one or more of transition metal carbides such as TiC, TaC, NbC, HfC and the like or mixed or composite carbides thereof including WC. Other iron group metals than Co, such as Ni and Fe, are also effective for the binder phase.

The following examples are given in order to illustrate the present invention without limiting the same.

EXAMPLES

Using two compositions as shown in Table 1, test pieces for transverse rupture strength and cutting inserts (Form No. SNU 432) were prepared in conventional manner. In the sintering furnace of the present invention as shown in the accompanying drawing, these samples were sintered and cooled from 1400° C., one sample being cooled gradually for comparison and the other three samples being rapidly cooled by a circulated gas with changing the cooling rate. This circulated gas was nitrogen and in the case of argon, the similar results were obtained.

TABLE 1

| Sample | WC | TiC | TaC | Co |
|---|---|---|---|---|
| A | 81.5 | 5.5 | 3 | 10 |
| B | 94.5 | — | 0.5 | 5 |

The test results are summarized in Table 2.

In a milling test effected as to Samples $A_0$, $A_1$, $A_2$ and $A_3$ under various conditions for comparison, Samples $A_1$, $A_2$ and $A_3$ are always superior to Sample $A_0$. In the former samples, thermal cracks generated possibly due to thermal fatigue are only half or less of those of the latter sample and the life against the thermal crack is at least two times as much as that of the latter sample. For example, when a workpiece to be cut SCM 3 (Hs=38) 1O×300 was subjected to a test with a 6 inch negative cutter under v(cutting speed)=150 m/min, f(cutting feed)=0.22 mm/edge and d(cutting depth)=5 mm while pouring a water-soluble liquid, Sample $A_0$ showed a breakage due to thermal crack after only three passes while Samples $A_1$, $A_2$ and $A_3$ showed no breakage even after six passes and only little thermal cracks.

TABLE 2

| Sample No. | Composition | Sintering Temperature °C. | Cooling Rate 1400→1000° C. °C./min | Alloy Properties: Density | Hardness HRA | Transverse Rupture Strength Kg/mm² | Cutting Test $V_B$ (m/m)* |
|---|---|---|---|---|---|---|---|
| $A_0$ | A | 1400 | 10 | 13.1 | 90.5 | 190 | 0.31 |
| $A_1$ | A | 1400 | 30 | 13.1 | 90.7 | 210 | 0.20 |
| $A_2$ | A | 1400 | 34 | 13.1 | 90.6 | 220 | 0.19 |
| $A_3$ | A | 1400 | 52 | 13.1 | 90.8 | 205 | 0.22 |
| $B_0$ | B | 1380 | 10 | 15.1 | 92.1 | 185 | 0.22 |
| $B_1$ | B | 1380 | 31 | 15.1 | 92.3 | 200 | 0.20 |
| $B_2$ | B | 1380 | 36 | 15.1 | 92.4 | 210 | 0.18 |
| $B_3$ | B | 1380 | 48 | 15.1 | 92.4 | 195 | 0.20 |

Note:
*$V_B$ means flank wear of a tool.

Cutting Test Conditions (turning test)

Sample Nos. $A_0$–$A_3$

| | |
|---|---|
| Workpiece to be cut | SCM 3 (steel) Hardness Hs = 38 |
| Cutting Speed | v = 100 m/min |
| Feed | f = 0.36 mm/rev |
| Cutting Depth | d = 2 mm |
| Time | t = 20 min |
| Holder | FN 11R-44 |

Sample Nos. $B_0$–$B_3$

| | |
|---|---|
| Workpiece to be cut | FC 25 (cast iron) Hardness Hs = 33 |
| Cutting Speed | v = 90 m/min |
| Feed | f = 0.35 mm/rev |
| Cutting Depth | d = 2 mm |
| Time | t = 15 min |
| Holder | FN 12 R-44 |

As apparent from these results, the strength (transverse rupture strength) and wear resistance of cemented carbides are increased by rapid cooling according to the present invention. Even in the case of low Co content alloys, an increase of the strength is realized. Furthermore, it is assumed that the wear resistance is increased due to that the solubility of tungsten in the cobalt phase is increased to thus raise the heat resistance (strength, hardness) of the cobalt phase, which is supported by the phenomenon that the above described effects are more remarkable in the case of cutting a steel piece than in the case of cutting a cast iron piece. In the turning or milling operations, in particular, the cemented carbides containing TiC and TaC exhibit more excellent properties in the cutting test of steels as shown above.

What is claimed is:

1. A sintering furnace for powder metallurgy of cemented carbides which comprises a main furnace body having a cooling means for cooling the interior of said furnace by a heat exchanger fitted to the exterior of the main furnace body, said main furnace body further containing therein a heating chamber, an inert gas inlet, a movable table to be moved slidably on graphite rails for carrying a workpiece by an endless chain mounted on sprockets, and an exhaust port disposed beneath said heating chamber for removal of a lubricant included in said workpiece, said heating chamber being surrounded by a heat insulator and being provided with a heating element and a door capable of being opened and shut from the outside of the furnace body, and when said door is in the open position said movable table being insertable in the lower portion of said heating chamber.

2. The sintering furnace for powder metallurgy according to claim 1 wherein said heat exchanger is provided with valves adapted to prevent new gases generated until the completion of sintering from reaching the heat exchanger.

* * * * *